US005762017A

United States Patent [19]

Groves

[11] Patent Number: 5,762,017

[45] Date of Patent: Jun. 9, 1998

[54] BEARING, TURNING AND LOCKING SYSTEM FOR USE ON A TURRET MOORED VESSEL

[75] Inventor: Frank W. Groves, Soluang, Calif.

[73] Assignee: Bardex Corporation, Goleta, Calif.

[21] Appl. No.: 672,262

[22] Filed: Jun. 26, 1996

[51] Int. Cl.[6] ..... B63B 21/00

[52] U.S. Cl. ..... 114/230; 114/230

[58] Field of Search ..... 114/230, 293; 441/3–5; 405/195.1

[56] References Cited

U.S. PATENT DOCUMENTS

| | | | |
|---|---|---|---|
| 3,365,734 | 1/1968 | Petrie et al. | 441/5 |
| 5,356,321 | 10/1994 | Boatman et al. | 114/230 |

FOREIGN PATENT DOCUMENTS

| | | | |
|---|---|---|---|
| 150889 | 7/1986 | Japan | 114/293 |
| 157488 | 7/1986 | Japan | 114/293 |

*Primary Examiner*—Sherman Basinger
*Attorney, Agent, or Firm*—Pravel, Hewitt, Kimball & Krieger

[57] ABSTRACT

A turret moored vessel with an improved bearing, turning and locking system includes a floating hull, a turret supported by the hull and rotatable relative to the hull and bearing assemblies forming an interface between the hull and turret. The bearing assemblies each include multiple passive blocks, preferably in the form of members (e.g. passive, spring loaded cylinders), that are attached at their lower end to the hull and at their upper end to a frame that supports horizonal and vertical crane wheels. Each cylinder is inwardly inclined along a radial line to form a first angle. There can be first and second pairs of cylinders in each bearing assembly, all four cylinders forming a plane or an annular plane. The first and second pairs of cylinders can be inclined toward each other. The first inward tilt provides stability against horizontal forces. The opposing cylinder tilts provided stability against rotational forces. A motor gear drive powers a pinion that engages a bull gear on the turret to rotate the turret.

21 Claims, 5 Drawing Sheets

BEARING, TURNING AND LOCKING SYSTEM FOR USE ON A TURRET MOORED VESSEL

SPECIFICATION

BACKGROUND OF THE INVENTION

1. Field of the Invention

The present invention relates to vessel mooring systems that include a turret for use in shipshape vessels and moored buoys in heavy sea conditions such as occur in unprotected waters. More particularly, the present invention relates to an improved turret type mooring system for use in heavy sea conditions wherein assemblies of motion control units are mounted as an interface in between the vessel and the turret. The control units vary the support pressure based upon distance, mechanical springs being included in cylinders as the position controllers in the preferred embodiment.

2. General Background

In recent years, the offshore oil and gas well drilling industry has shifted away from fixed platforms toward more floating production and subsea completion schemes. A result of this shift has been the fabrication of more and larger turret type vessels and the turrets that are used on such shipshape vessels and in various designs of moored buoys.

In the case of smaller turrets, rigid bearing systems have generally been successful. However, because of vessel deflections under very heavy sea conditions, larger turret designs have a need for some compliance between the turret and the vessel.

Currently, turrets are available that include compliant plane bearing systems. These existing plane bearing systems use gripper jacks for turning and locking. Some crane wheel type bearing systems have been used to form an interface between the turret and the ships hull. Some currently available designs use a pinion and ball gear for turning and locking the turret relative to the ships hull.

Various mooring systems have been patented that include a turret type mooring system designed generally to operate in unprotected or rough waters. The Orthloff et al. U.S. Pat. No. 4,604,961 discloses an apparatus for mooring a vessel in unprotected waters. The vessel contains a recess in its hull adapted for receiving a buoyant mooring element. The mooring element is attached to the oceans floor by a plurality of mooring lines. The mooring element can be releasably secured within the recess. The buoyancy of the mooring element is established such that on release from the vessel it sinks to a predetermined depth a spaced distance above the ocean floor. This differs from the present invention wherein the turret is supported not by buoyancy but by bearing assemblies that extend from the hull upwardly to engage the turret and wherein the bearing motion controllers are passive members.

U.S. Pat. Nos. 4,698,038 and 4,701,143 each describe a vessel mounted mooring system and a method for its installation. The method involves the construction of a vertical well in the vessel extending from the deck through the bottom plates of the vessel. A lower bearing ring which circumscribes the well is connected to the underside of the bottom plates. A lower turret unit is laterally guided by the lower bearing ring and is restrained against uplift forces by the lower bearing ring. A middle turret unit is placed into the well and connected to the lower turret unit. An upper bearing ring which circumscribes the well is mounted to the deck. The upper turret unit is connected to the middle turret unit whereupon the weight of the assembly of the upper, middle and lower turret units is supported by the upper turret unit and is guided by the upper bearing ring. Chain lockers which include chains and windlasses are mounted to the upper turret unit for selectively paying out or reeling in chain through the upper, middle and lower turret units to allow the chain to be connected near the subsea floor. This construction differs from the present invention in that the interface between turret and hull is by means of non-compliant small roller bearings.

An apparatus for replacement of a swivel atop a first, operating foundation on a turret of a production ship or offshore platform is disclosed in U.S. Pat. No. 5,482,484. The apparatus comprises a swivel lifting a moving apparatus for taking a swivel off or replacing a swivel on the first operating foundation on the turret and a second storing foundation spaced from the turret. While this patent relates generally to turret moored ships, it relates primarily to the problem of the swivel and not the bearing system that supports the turret vertically, horizontally and relative to rotational forces.

Another turret device is disclosed in U.S. Pat. No. 5,065,689. In the '689 patent, the turret comprises a lower radial sliding bearing with relatively small width and larger diameter and an upper spherical axial bearing with relatively small diameter. The rest of the turret can be disconnected from the upper spherical bearing by a multiple thread, non-selflocking screw connection between a sleeve and a hub, which in connected position are locked by a dog clutch. When disconnected, the turret will sink to a stable equilibrium a distance below the ocean surface. The turret device can be fitted forward of the bow of a ship, or between the bow and midship. This reference differs from the present invention because it relies upon a floating buoyant structure to hold the turret in place.

U.S. Pat. No. 4,955,310 issued to Pollack provides a bearing arrangement for mounting a turret on the outer ends of beams whose inner ends are supported by a vessel that can weathervane about the turret. A lower bearing arrangement that mounts a lower portion of the turret in rotation about a vertical axis to a lower beam, permits the lower turret portion to pivot about a pair of lower horizontal axes. An upper bearing arrangement that mounts an upper portion of the turret to an upper beam in rotation about the vertical axis, permits the upper turret portion to pivot about a pair of upper horizonal axes. The '310 patent differs from the present invention because it is a substantially non-compliant structure.

U.S. Pat. No. 5,279,245 relates to a protection device for a turret bearing arranged between a floating structure and a mooring member. A turret bearing is arranged at or below water level to provide an effective introduction of forces as near the lower side of the floating structure as possible. To guarantee lubrication of the turret bearing a labyrinthine chamber is provided around the turret bearing. The downwardly extending part of this chamber is realized by the floating structure and more particularly a reinforced box whilst the upwardly extending part is provided by a wall extending from the body of the mooring member. This reference differs from the present invention because it relies upon buoyancy to hold the turret in position.

The Glorstad U.S. Pat. No. 5,051,035 relates to a device for supporting a turn table on a vessel, especially a vessel for use in connection with drilling for and production of oil which vessel is anchored to a seafloor, via the turntable. The turntable comprises a horizonal circular flange portion and a cylindrical portion extending coaxially relative to the latter and downwards from the flange portion into a vertical through hole in the hull. A plurality of bearing members are adapted to bear against the respective bearing faces of the turntable flange portion. The bearings permit relative rotation of the turntable and the hull about a substantially vertical axis. First and second bearings are provided beneath the peripheral portion of the turntable flange and are designed to support the turntable. The turntable can be moved in a vertical direction between a first lowered position and a second raised position. In the first position, the turntable is carried only by the first bearings and in the second position the turntable is carried only by the second bearings means. This reference differs from the present invention because it does not provide passive motion control elements spaced circumferentially about the periphery of the turret.

A floating oil/gas production terminal is disclosed in U.S. Pat. No. 5,279,240. The '240 patent relates to a terminal comprising a multi-hull vessel having a plurality of vertically shaped barge form hulls interconnected together to form a unitary structure including an upper hull which floats the vessel and a lower hull which provides gas/oil/other liquid storage space. A vertical throughway extends through the hull towards one end thereof and a manifold system is disposed in the free space between the hulls and is mounted for rotation on the upper and/or lower hulls about a vertical axis extending through the throughway to receive a plurality of pipelines connected directly or indirectly to seabed wellheads. A rotary fluid coupling is provided having two elements relatively rotatable about the vertical axis. One element has a connection to a conduit mounted on the upper hull and a second element is connected by a conduit to the manifold system between the hulls whereby the vessel may swing about the vertical axis leaving the manifold system and pipe line(s) connected thereto stationary with respect to the seabed. The bearings are small radial load rollers that are small and generally non-compliant in heavy seas.

A ship with a mooring structure is disclosed is U.S. Pat. No. 5,266,061 issued to Poldervaart et al. The '061 patent mooring structure comprises a rotatable tube which is connected to the ship for rotation about a vertical axis which is concentric to the rotating tube, by an axial/radial bearing structure which can absorb axial and radial forces. The rotatable tube has at its lower end structure for fastening anchor chains or cables. The rotatable tube is disposed inside the hull of the ship within a fixed tube through the lower end of which the rotatable tube protrudes downwardly. An outer ring of the axial/radial bearing is in integral assembly with a rigid ring which is in turn fastened only to the lower end of the fixed tube. The fixed tube encloses the rotatable tube with clearance and is fastened to the hull of the ship only some distance away from and above the rigid ring and is free from fixed securement to the ship below the rigid ring. Racking of the hull thus cannot be transmitted to the bearing but rather is absorbed by that portion of the fixed tube that extends between the hull and the rigid ring. The small roller bearings used would be generally non-compliant in heavy seas.

A turret for a drilling or production ship is disclosed is U.S. Pat. No. 5,359,957. The turret can be used on a drilling or production vessel for the recovery of oil offshore. It is installed in such a manner that it can rotate in a through going opening or well in the hull of the vessel and includes bearing arms which are equipped with axially and radially fitted bearing elements which act against corresponding bearing elements on the vessel. The bearing arms are connected to a substructure in the turret which provide individual suspension to and can absorb unevennesses and deformations in the bearing. A track of the axial bearing is disposed on a pedestal-like elevated area is connected with the hull, mainly at the level of the neutral axis of the vessel, and the radial bearing element on the vessel is in the form of a band-like structure. This construction differs from the present invention because compliance is achieved structurally, the wheels are mounted to the turret, and a separate means is required for turret rotation.

A system for rotatably mounting a vessel to a loading buoy is disclosed in U.S. Pat. No. 5,468,166 issued to Breivik et al. The apparatus can be used for loading or unloading a flowable medium, especially oil from a vessel at sea. The buoy includes an outer member and a central member rotatably mounted in the outer member. The central member forms a passage for the flowable medium from the lower end of the buoy which is connected to a transfer line to a tube system within the vessel. The outer member is received and latched in an opening in the bottom of the vessel. The central member is connected to the tube system by a swivel coupled to the upper end of the central member by a flexible joint which allows angular displacement about the axis of connection. This construction differs from the present invention because a floating member is required.

The Pollack U.S. Pat. No. 5,381,750 relates to a vessel with a rotatable turret thereon moored in a manner that minimizes turret tilt while avoiding the need to maintain precisely concentric upper and lower turret bearings. A mooring structure is formed by a group of mooring lines such as chains, with the upper ends of the lines coupled to the vessel through a connecting apparatus that comprises a group of arms each connected to a corresponding one of the lines. Each arm is pivotally mounted on the turret to hang therefrom, so the arms transmits primarily vertical forces to the turret and the turret bearing has to support primarily vertical forces. Each arm carries a bearing pad that presses horizontally against a vessel lower bearing ring mounted directly on the vessel hull independently of the turret. Substantially the entire horizontal components of the mooring force are transmitted from the arm pads to the lower vessel bearing ring, so the horizontal force components are not transmitted through the turret. This differs from the present invention in that the turret does not tend to tilt, and the vessel lower bearing ring which transmits horizonal mooring force components does not have to be mounted precisely concentric with the upper bearing.

The Carlsen U.S. Pat. No. 4,753,553 discloses a bearing structure which may, for example, be used for rotatable mounting of a turret or a rig on a hull of a vessel. The apparatus comprises a first annular bearing surface which is supported by the vessel hull, and which may be substantially plane or cylindrical. A second annular bearing surface which is an engagement with and supported by the first bearing surface is formed on the turret or rig. The hull of the vessel is exposed to heavy forces caused by wind and waves, and such forces may cause deformation of the hull and consequently of said first bearing surface. In order to compensate for such deformations, the first bearing surface is divided into sections, and a position controller (such as mechanical, pneumatic, or hydraulic springs) are provided for maintaining all of the bearing surface sections in abutting engagement with said second bearing surface formed on the turret or rig. The hydraulic springs may be in the form of hydraulic cylinders or jacks to which hydraulic fluid is supplied at a pressure which is increased which the distance between the respective bearing surface section and the supporting part of the hull is decreased due to deformation of the hull and vice versa. The Carlson patent does not use passive motion control elements that vary support pressure with distance nor a single motion control frame that carries the rotational and locking portion of the apparatus as well as rollers that support the turret, the rollers having a frame carried by the motion control elements.

Some patents have issued that relate to crane wheel type bearing systems. For example, U.S. Pat. No. 4,354,606 discloses a bearing assembly for a pedestal crane. The assembly includes at least one arcuate shoe adapted to be disposed about the pedestal and mounted with the upperworks of the pedestal crane, with mounting members for releasably mounting the arcuate shoe with the upperworks of the pedestal crane, and further having bearings with the arcuate shoe for engaging the outer surface of the pedestal for reducing friction between the upperworks and the pedestal when rotating the upperworks of the pedestal crane about the pedestal.

Since each of the above discussed U.S. Pat. Nos. 4,604,961; 4,698,038; 4,701,143; 5,482,484; 5,065,689; 4,955,310; 5,279,245; 5,051,035; 5,279,240; 5,266,061; 5,359,957; 5,468,166; 5,381,750; and 4,753,553 are disclosures of the broad concept of a vessel (such as an oil well drilling on production vessel) that has a rotating turret, they are all hereby incorporated herein by reference.

SUMMARY OF THE INVENTION:

Most of the above discussed patents disclose non-compliant type bearing systems. These non-compliant designs are generally acceptable for smaller vessels and in less than very heavy sea conditions. However, these prior art type systems suffer in extremely heavy sea conditions. In such extreme heavy sea conditions, some compliance is required between the turret and the vessel because of vessel deflection. It is to this problem that the present invention is directed, being an improved system for use on turret moored vessels. The present invention thus provides an improved bearing, turning and locking system for use on turret moored vessels.

The apparatus of the present invention incorporates all vertical and horizonal support plus the turning or rotating and locking onto a single flange which projects out from the turret.

Stability against horizonal forces is provided by a first inward tilt angle of a plurality of support cylinders. Stability against turret rotational forces is provided by opposing cylinder tilts in a generally annular plane. Cylinder spring rate is provided by a compressed stack of pads (for example fabreeka) within each cylinder on the blind end side. For example, the assemblies of bearing members can include four cylinders including a left pair and a right pair. All four cylinders would preferably be tilted inwardly with respect to the axis of rotation of the turret (or toward an annular plane defined by an outer turret flange bearing surface), this being the first inward tilt angle. The top of the left pair of cylinders would be tilted toward the right pair of cylinders. The top of the right pair of cylinders would be tilted toward the left pair of cylinders. This tilting of the respective pairs of cylinders toward each other is the second tilt angle.

With the improved apparatus of the present invention, the vertical, horizontal and rotational stiffness of the system can be varied by changing the cylinder spring rate and/or either of the angles of tilt.

One of the advantages of the present invention is that both vertical and horizontal support systems are passive, i.e., no active control system is required.

The present invention bearing, turning, and locking system includes a floating hull, a turret supported on the hull, the turret being rotatable relative to the hull. The turret is generally circular in shape, including a generally horizonal planar circular section and a generally vertically extended annular section that is generally cylindrically shaped. A plurality of bearing assemblies are provided for forming an interface between the hull and the turret. Each of the bearing assemblies includes a plurality of motion controllers for varying the support on the turret based upon the distance between the turret and the hull.

The motion controllers can include a plurality of extensible members that define an interface between the hull and the turret at the vertically extended annular section and at the horizonal planar section adjacent the intersection of the two turret sections.

The motion controllers are preferably multiple passive springs that extend between the hull and the turret.

A motor drive is provided to rotate the turret relative to the hull. The motor drive can include a motor with an attached pinion gear carried by the motion controller frame and a toothed bull gear attached to the turret. The bull gear engages the pinion gear so that rotation of the pinion gear effects a rotation of the bull gear and turret relative to the hull. Each of the bearing assemblies preferably include a plurality of extensible members that occupy a plane.

The plurality of bearing systems are spaced circumferentially about the turret.

A plurality of rotary members are positioned on the hull to bear against the turret. The rotary members are preferably in the form of a plurality of wheels including at least one wheel that rotates about a generally vertical axis and at least one wheel that rotates about generally horizonal axis. In the preferred embodiment, the rotary members include a first plurality of wheels that rotate about a vertical axis and another plurality of wheels that rotate about a horizontal axis. The motion controllers can include a plurality of extensible cylinders that have internal springs. However, in the preferred embodiment these controllers are passive and only require hydraulic fluid to facilitate installation and removal for repairs.

The passive cylinders can be either hydraulic or pneumatic.

In the preferred embodiment, a plurality of bearing blocks comprise each of the bearing assemblies. For example, four bearing blocks in the form of extensible cylinders can be used with each bearing assembly. The bearing blocks preferably incline with respect to the center of rotation of the turret.

The plurality of blocks can also be inclined relative to each other yet remain in a common plane. For example, four bearing blocks in the form of extensible cylinders can be provided in left and right pair of blocks. The left handed pair would be inclined toward the central longitudinal axis of the other extensible cylinders and with respect to a vertical line. The first angle of inclination of each of the cylinders provides an inward tilt that provides stability against horizontal forces. The inclination of the first and second pairs of cylinders toward each other provides stability against rotational forces.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
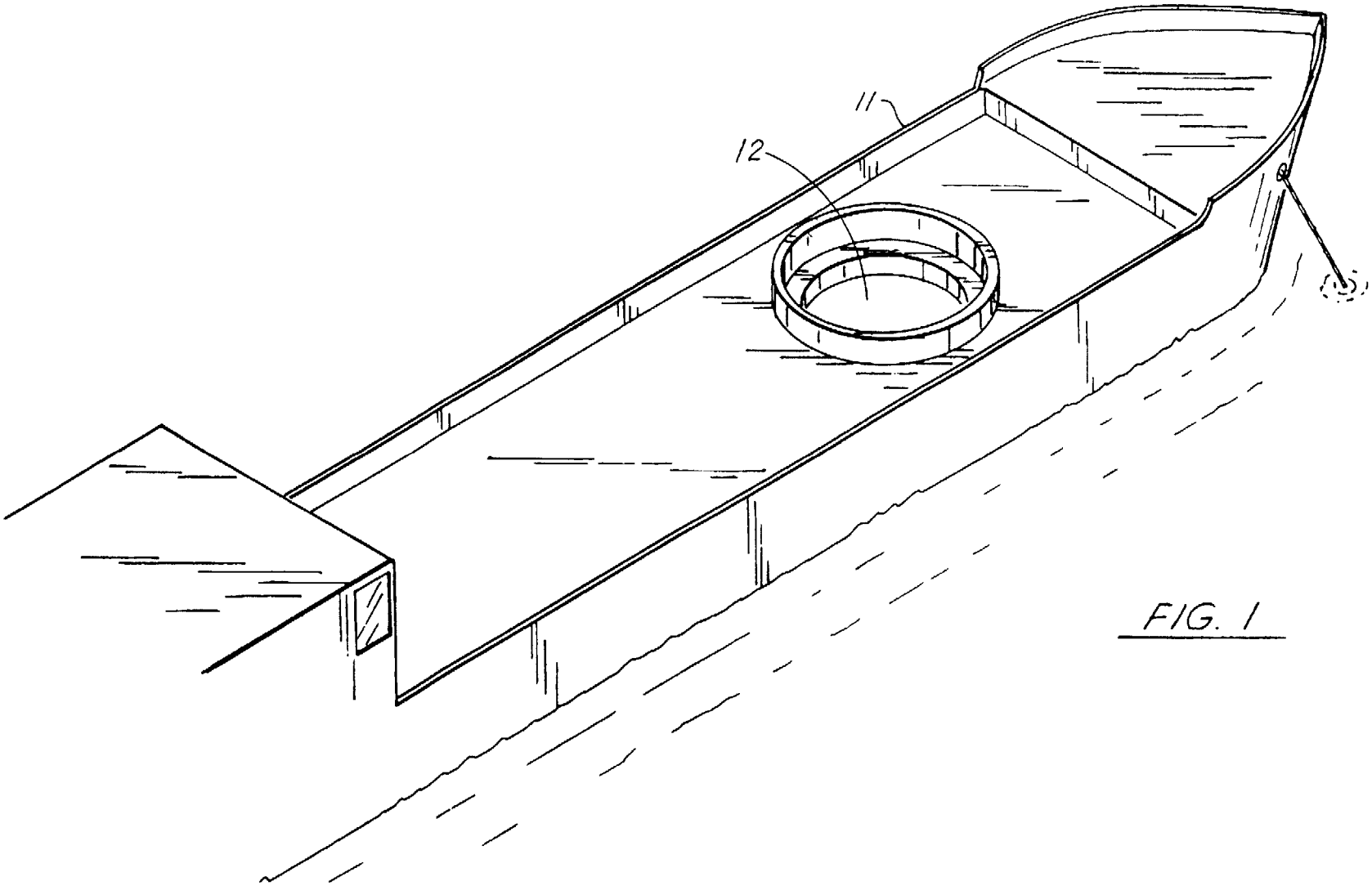
FIG. 1 is a perspective schematic view of the preferred embodiment of the apparatus of the present invention.

FIGS. 1–4 show the preferred embodiment of the apparatus of the present invention designated generally by the numeral 10. Bearing, turning and locking system 10 can be used to define and interface between a floating hull 11 such a floating oil and gas well drilling platform and a rotating turret 12 that can be attached to an undersea oil and gas well. Winches and anchor lines can be used for example to moor the combination of the vessel 11 and turret 12 to an ocean floor at an oil and gas well.

Figure 2:
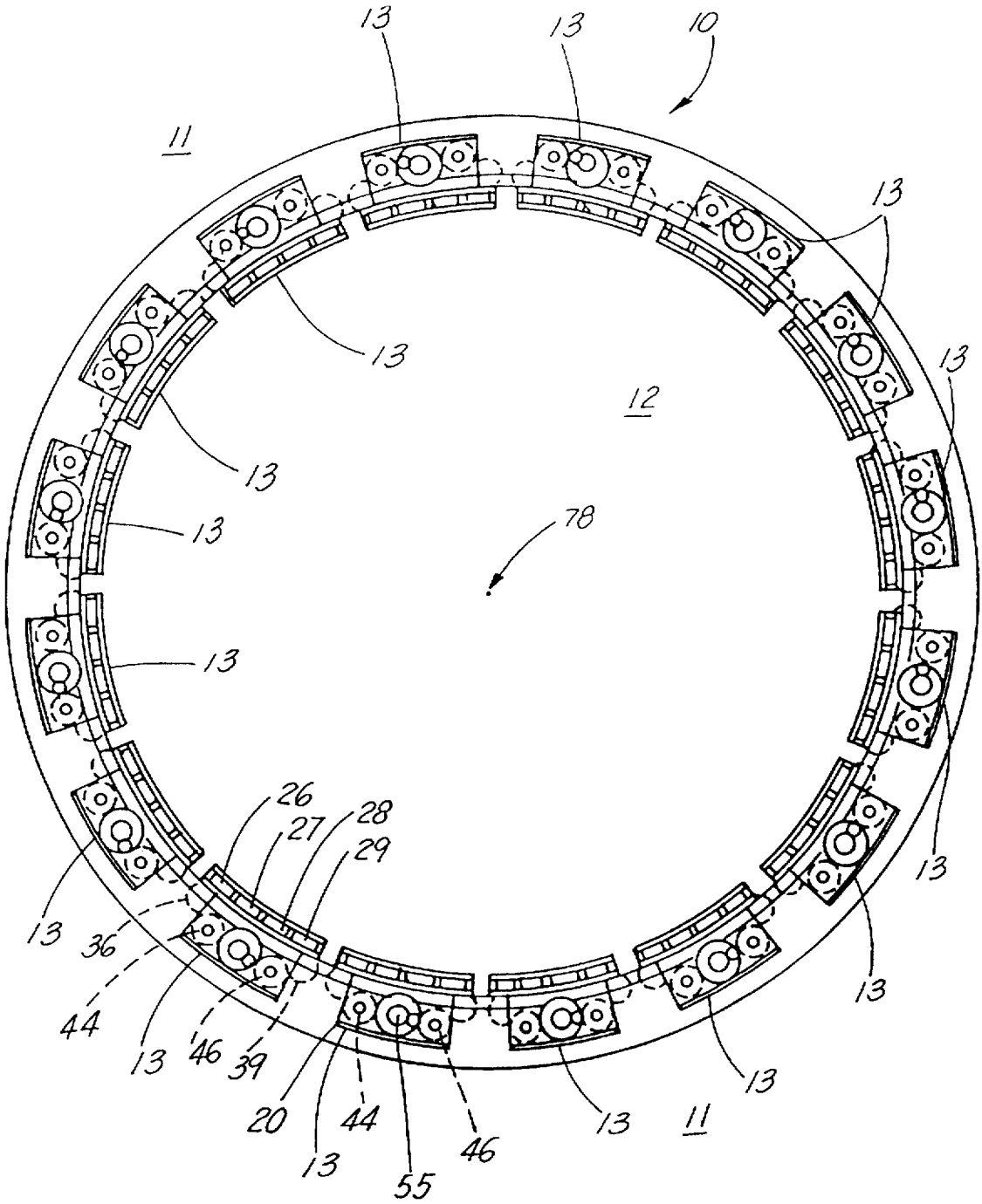
FIG. 2 is a plan view of the preferred embodiment of the apparatus of the present invention.

An interface is formed between turret 12 and the vessel hull 11 using a plurality of bearing assemblies 13 as shown in FIG. 2. Each bearing assembly 13 is shown in more detail in FIGS. 3 and 4.

Figure 3:
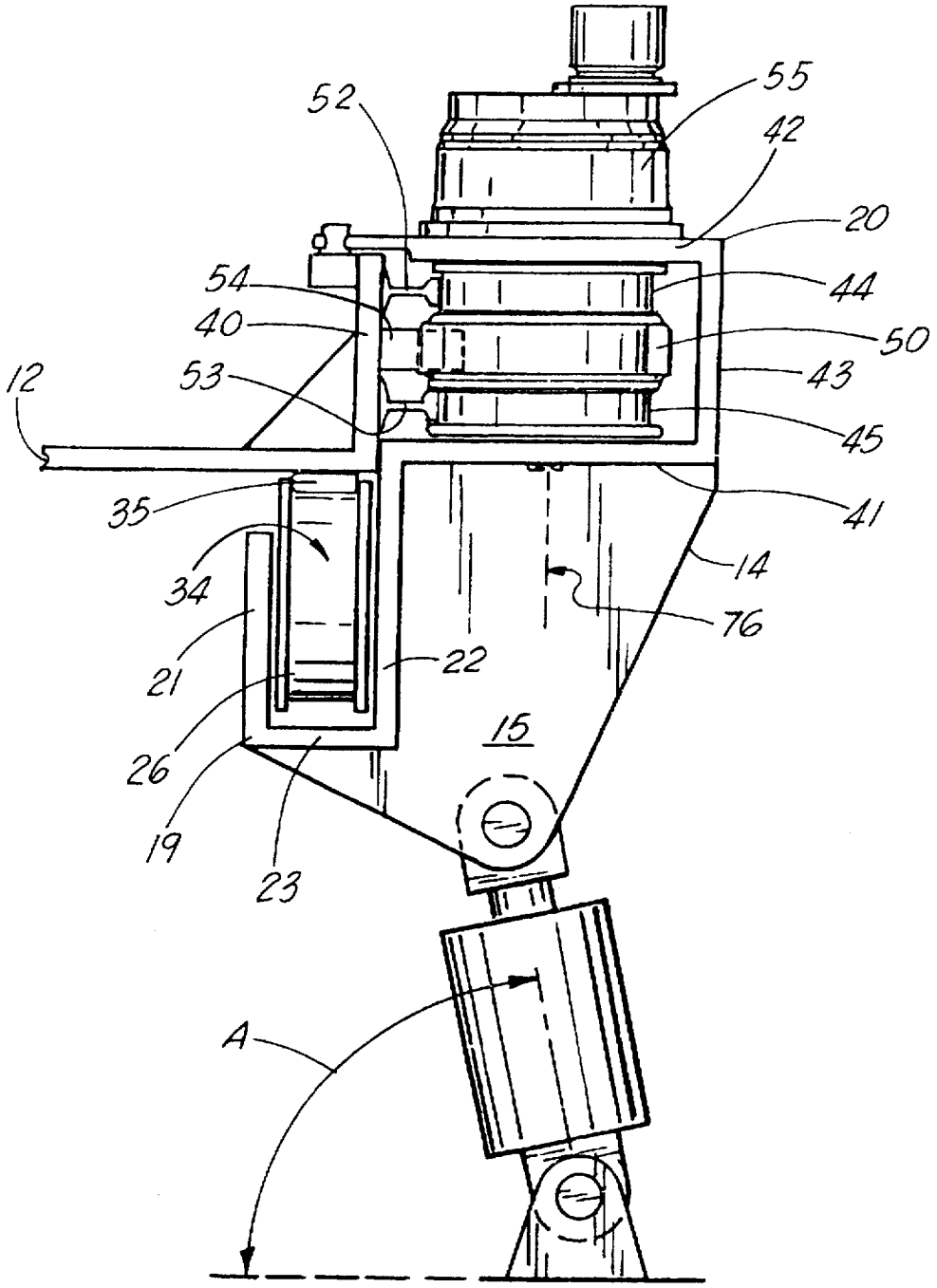
FIG. 3 is a partial, radial sectional elevational view of the preferred embodiment of the apparatus of the present invention.
Figure 4:
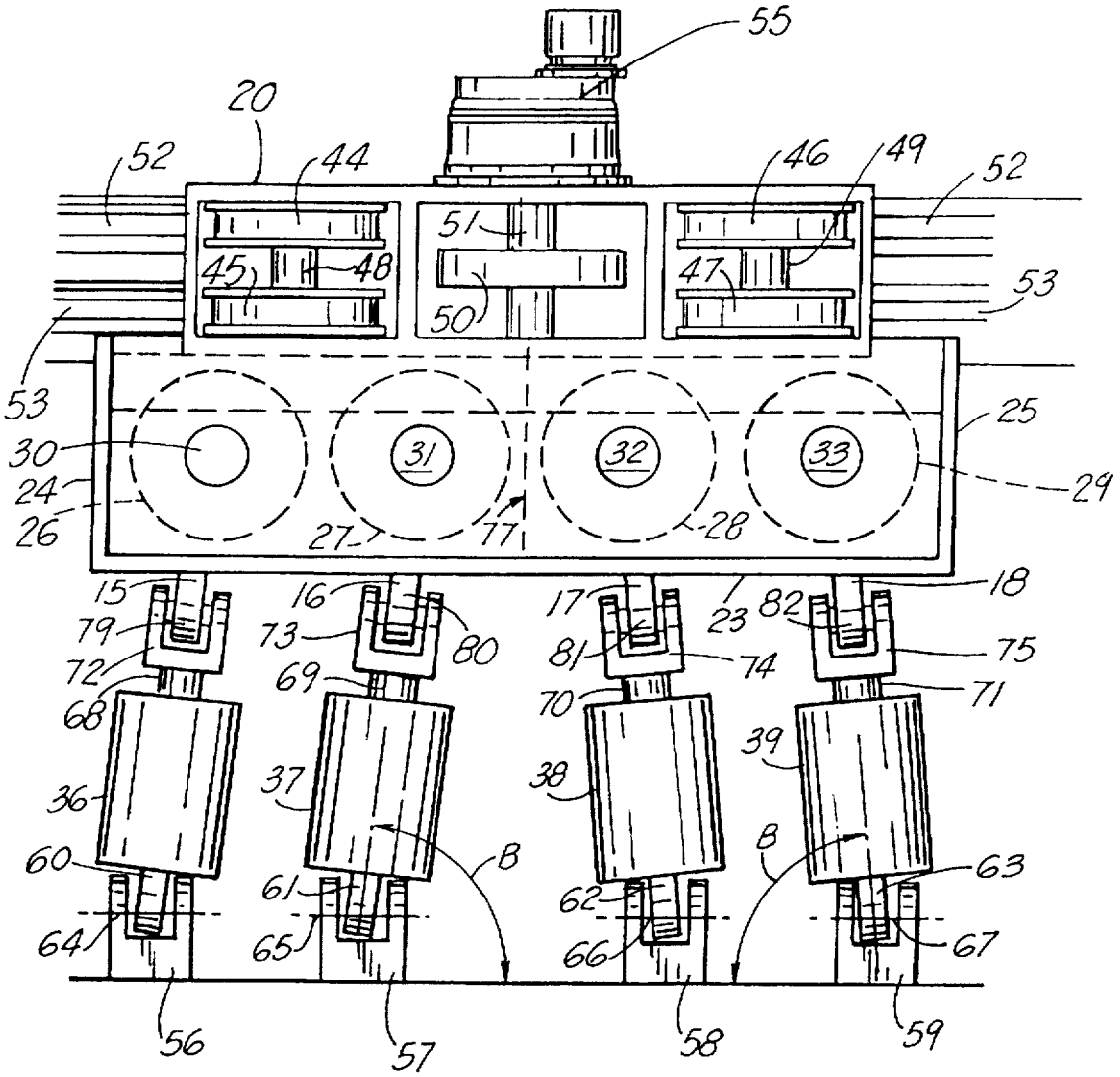
FIG. 4 is a partial sectional, elevational view of the preferred embodiment of the apparatus of the present invention viewed from the rear of a bearing assembly.

In FIGS. 3–4, each bearing assembly 13 includes a structural frame 14 that is supported by a plurality of passive members 36, 37, 38, 39 such as spring loaded cylinders 36, 37, 38, 39 using a plurality of plates 15, 16, 17, 18 as shown in FIGS. 2 and 3. Frame 14 supports a lower vertical crane wheel housing 19 and an upper horizontal crane wheel housing 20. Cylinder 36, 37, 38, 39 can also be hydraulic or pneumatic.

Vertical crane wheel housing 19 can be formed of a casting on a plurality of plate sections of welded structural steel, for example. Vertical crane wheel housing 19 includes front plate section 21, rear plate section 22, bottom plate section 23, and side walls 24, 25.

Within vertical crane wheel housing 19, there are a plurality of vertical crane wheels 26, 27, 28, 29. Each vertical crane wheel 26, 27, 28, 29 is mounted upon a horizontal shaft 30–33 respectively. Each vertical crane wheel 26–29 presents an annular bearing surface 34 that engages and bears against flat rail 35.

Flat rail 35 tracks a circular path about the periphery of turret 12 adjacent to flange surface 40 as shown in FIG. 3. The plurality of passive members such as extensible cylinders 36, 37, 38, 39 are mounted structurally upon hull 11. Each of the cylinders 36, 37, 38, 39 is inclined a first angle "A" as shown in FIG. 3 with respect to the vertical axis 76 of horizontal crane wheels 44, 45, 46, 47. Axis 76 is parallel to the axis of rotation 78 of turret 12.

The turret 12 presents an annular flange bearing surface 40 that carries a pair of spaced apart crane rails 52, 53. Rails 52, 53 extend 360° about periphery of turret 12 at flange surface 40. The inclined cylinders 36, 37, 38, 39 are positioned to place the horizontal crane wheels 44, 45, 46, 47 into frictional bearing engagement with rails 52, 53, as shown in FIG. 2.

The wheels 44, 45 rotate with shaft 48 while wheels 46, 47 rotate with shaft 49. The wheels 44, 45 and 46, 47 rotate about axes that form an angle of between about 70 and 110 degrees (preferably 90 degrees) with respect to the axes of rotation of wheels 26, 27, 28 and 29.

Horizontal crane wheels 44, 45, 46, 47 are contained within horizontal crane wheel housing 20. Crane wheel housing 20 can be formed of a plurality of plate sections of welded structural steel for example. The crane wheel housing 20 includes bottom plate section 41, top plate section 42, and rear plate section 53. Side walls can also be provided for horizontal crane wheel housing 20 as with vertical crane wheel housing 19.

Annular flange bearing surface 40 of turret 12 carries bull gear 54. Bull gear 54 extends 360° abut the periphery of turret 12 at flange surface 40. Bull gear 54 can be positioned in between rails 52, 53 as shown. The bull gear 54 has regularly spaced teeth that mesh with correspondingly sized and shaped teeth of pinion gear 50.

In FIGS. 3 and 4, a combination motor, brake, gear box assembly 55 is mounted to drive pinion gear 50 shaft 51. When motor drive portion of motor, brake, gear box assembly 55 is activated, it rotates pinion gear 50. This causes the toothed portion of pinion gear 50 that engages bull gear 54 to rotate bull gear 50 thus rotating turret 12 relative to bearing assembly 13 and hull 11.

Two cylinders 36, 37 that are the left hand pair of cylinders in FIG. 4 are inclined inwardly toward pinion gear 50 drive shaft 51. In FIG. 4, the vertical axis of pinion shaft 51 is indicated by the numeral 77. The left hand pair of cylinders 36, 37 are inclined as shown in FIG. 3 so that the top portion of each cylinder 36, 37 is inclined toward pinion shaft 51 axis 77. The right hand pair of cylinders 38, 39 are inclined so that the top of each cylinder 38, 39 is inclined to the left, toward axis 77 of pinion shaft 51. In FIG. 4, the angle of inclination of each of the left hand cylinders 36, 37 is indicated as angle "B". As the angle of inclination between each of the right hand cylinders 38, 39 is the same as the angle of inclination for cylinders 36, 37 it is also indicated as "B" in FIG. 4.

In FIG. 3, the cylinder shown is cylinder 36. It is inclined an angle "A" with reference to axis 76. The top portion of cylinder 36 is inclined an angle "A" toward the axis of rotation of turret 12 indicated as 78 in FIG. 1. Thus, each cylinder 36, 37, 38, 39 is inclined inwardly toward axis 76 of rotation of turret 12 and toward the opposing pair of cylinders a measure angle "B" relative to vertical. This tilting of the cylinders 36, 37, 38, 39 maintains all cylinders 36, 37, 38, 39 generally in a plane or annular plane that is corresponding to annular planar flange surface 40.

Each cylinder 36, 37, 38, 39 attaches to a respective deck padeyes 56, 57, 58, 59. The deck padeyes 56–59 are structurally connected to hull 11. Each cylinder 36, 37, 38, 39 has a lower end 60, 61, 62, 63 respectively that forms a connection at pinned, spherical bearing connections 64, 65, 66, 67 respectively with the pad eyes 56, 57, 58, 59.

Each cylinder 36, 37, 38, 39 provides a pushrod portion 68, 69, 70, 71 respectively. Each pushrod 68–71 has a U-shaped yoke 72, 73, 74, 75 respectively that forms a pinned connection 79–82 respectively with plate sections 15–18.

Figure 5:
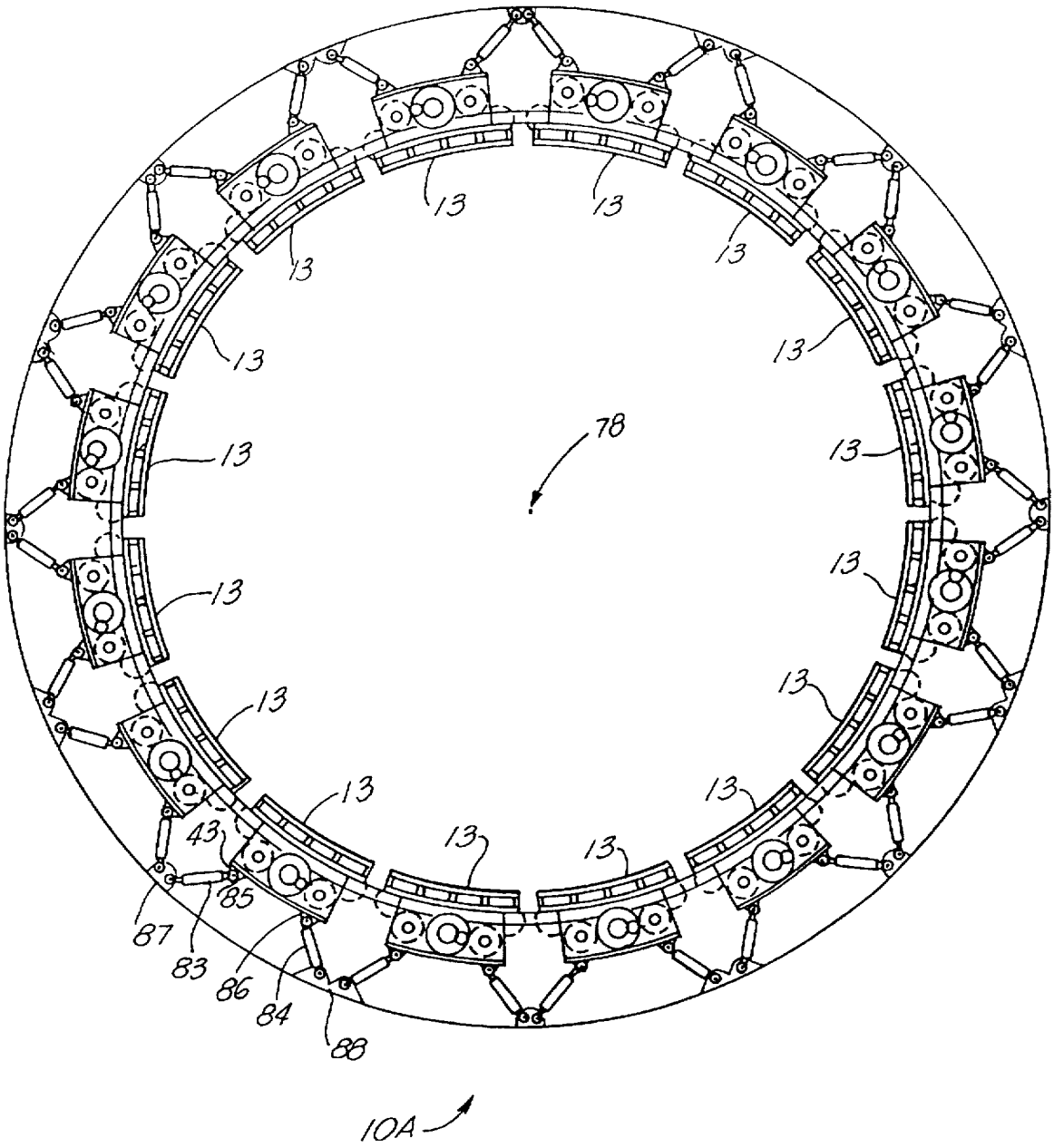
FIG. 5 is a plan view of an alternate embodiment of the preferred embodiment of the apparatus of the present invention.

In FIG. 5, an alternate embodiment of the apparatus of the present invention is shown, designated generally by the number 10A. Bearing, turning, and locking system 10A is constructed in the same manner as shown and described in FIGS. 1–3, though additional passive members (e.g.

cylinders) are used. In FIG. 5, each bearing assembly 13 includes diagonally extending cylinder 83, 84 that extend between hull 11 and frame 14. Padeyes 85, 86 can be affixed to rear plate section 43 of horizontal crane wheel housing 20. Padeyes 87, 88 can be affixed to hull 11. The padeyes 85, 86 and 87, 88 are so positioned that cylinders 83, 84 are horizontally oriented, and generally occupy a plane perpendicular to axis of rotation 78 of turret 12. Pinned connections with spherical bearings can be used to affix each cylinder 83, 84 to its respective padeyes 85, 87 and 86, 88. The embodiment of FIG. 5 uses the cylinders 83, 84 to afford additional stability against horizontal forces.

The following table lists the parts numbers and parts descriptions as used herein and in the drawings attached hereto.

PARTS LIST

| Part Number | Description |
|---|---|
| 10 | mooring system |
| 10A | mooring system |
| 11 | hull |
| 12 | turret |
| 13 | bearing assembly |
| 14 | frame |
| 15 | plate |
| 16 | plate |
| 17 | plate |
| 18 | plate |
| 19 | vertical crane wheel housing |
| 20 | horizontal crane wheel housing |
| 21 | front plate section |
| 22 | rear plate section |
| 23 | bottom plate section |
| 24 | side wall |
| 25 | side wall |
| 26 | vertical crane wheel |
| 27 | vertical crane wheel |
| 28 | vertical crane wheel |
| 29 | vertical crane wheel |
| 30 | horizontal shaft |
| 31 | horizontal shaft |
| 32 | horizontal shaft |
| 33 | horizontal shaft |
| 34 | annular surface |
| 35 | flat rail |
| 36 | cylinder |
| 37 | cylinder |
| 38 | cylinder |
| 39 | cylinder |
| 40 | annular bearing surface |
| 41 | bottom plate section |
| 42 | top plate section |
| 43 | rear plate section |
| 44 | horizontal crane wheel |
| 45 | horizonal crane wheel |
| 46 | horizontal crane wheel |
| 47 | horizontal crane wheel |
| 48 | vertical shaft |
| 49 | vertical shaft |
| 50 | pinion gear |
| 51 | pinion gear shaft |
| 52 | crane rail |
| 53 | crane rail |
| 54 | bull gear |
| 55 | motor, brake, gearbox assembly |
| 56 | deck padeye |
| 57 | deck padeye |
| 58 | deck padeye |
| 59 | deck padeye |
| 60 | cylinder lower end |
| 61 | cylinder lower end |
| 62 | cylinder lower end |
| 63 | cylinder lower end |
| 64 | pinned connection, spherical bearing |

-continued

PARTS LIST

| Part Number | Description |
|---|---|
| 65 | pinned connection, spherical bearing |
| 66 | pinned connection, spherical bearing |
| 67 | pinned connection, spherical bearing |
| 68 | pushrod |
| 69 | pushrod |
| 70 | pushrod |
| 71 | pushrod |
| 72 | yoke |
| 73 | yoke |
| 74 | yoke |
| 75 | yoke |
| 76 | vertical axis |
| 77 | vertical axis |
| 78 | turret rotational axis |
| 79 | pinned connection, spherical bearing |
| 80 | pinned connection, spherical bearing |
| 81 | pinned connection, spherical bearing |
| 82 | pinned connection, spherical bearing |
| 83 | horizontal cylinder |
| 84 | horizontal cylinder |
| 85 | padeye |
| 86 | padeye |
| 87 | padeye |
| 88 | padeye |
| A | angle |
| B | angle |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A bearing, turning, and locking system for use on a turret moored vessel comprising;

a) a floating hull;

b) a turret supported at the hull;

c) the turret being rotatable relative to the hull;

d) a bearing frame that forms an interface between the turret and the hull;

e) a power drive on the bearing frame for rotating the turret relative to the hull;

f) locking means on the bearing frame for locking the turret to the hull;

g) the turret including a generally horizontal planar section and a generally vertically extended annular section each having bearing surfaces thereon that extend about the periphery of the turret;

h) a plurality of bearing assemblies shaped circumferentially about the turret, each assembly forming an interface between the hull and the bearing frame; and i) each bearing assembly including a plurality of motion controllers for varying support pressure on the bearing frame, said motion controllers providing variable support pressure based upon the distance between turret and the hull.

2. The bearing, turning, and locking system of claim 1 wherein the bearing assembly includes a plurality of extensible members that define an interface between the hull and turret at the vertically extended annular section and at the horizontal planar section.

3. The bearing, turning, and locking system of claim 1 wherein the motion controllers include multiple passive springs that extend between the hull and turret.

4. The bearing, turning, and locking system of claim 1 further comprising a motor drive and a pinion gear carried by the hull, and a bull gear attached to the turret, wherein the pinion gear engages the bull gear so that rotation of the pinion gear rotates the bull gear and turret relative to the hull.

5. The bearing, turning, and locking system of claim 1 wherein the bearing assemblies comprise a plurality of bearing assemblies that each form an interface between the hull and the turret, each assembly including inclined, extensible members that occupy a plane.

6. The bearing, turning, and locking system of claim 5 wherein each bearing assembly includes said frame, a plurality of said extensible members that each have an end portion mounted respectively on the hull and to the frame, and a plurality of rotary members on the frame that bear against the turret.

7. The bearing, turning, and locking system of claim 6 wherein the rotary members comprise a plurality of wheels, including at least one wheel that rotates about a generally vertical axis and at least one wheel that rotates about a generally horizontal axis.

8. The bearing, turning, and locking system of claim 6 wherein the rotary members include a plurality of wheels that rotate about respective first and second axes that form an angle of between 70 and 110 degrees.

9. The bearing, turning, and locking system of claim 6 wherein the rotary members include a plurality of wheels that rotate about respective first and second axes that form an angle of about ninety (90° ) degrees.

10. The bearing, turning and locking system of claim 1 wherein the controllers include a plurality of extensible cylinders.

11. The bearing, turning, and locking system of claim 10 wherein the cylinders are hydraulic.

12. The bearing, turning, and locking system of claim 10 wherein the cylinders are pneumatic.

13. The bearing, turning, and locking system of claim 1 wherein the bearing assemblies include a plurality of rotatable members supported by the hull.

14. The bearing, turning, and locking system of claim 13 wherein at least some of the rotatable members are mounted on radially extending axes.

15. The bearing, turning, and locking system of claim 13 wherein the turret rotates about a turret axis of rotation and at least some of the rotatable members are mounted on axes that are parallel to the turret axis of rotation.

16. The bearing, turning, and locking system of claim 1 wherein each bearing assembly includes said frame, said plurality of said motion controllers that each have an end portion mounted respectively on the hull and to the frame, and a plurality of rotary members on the frame that bear against the turret.

17. The bearing, turning, and locking system of claim 16 wherein the rotary members comprise a plurality of wheels, including at least one wheel that rotates about a generally vertical axis and at least one deleted wheel that rotates about a generally horizontal axis.

18. The bearing, turning, and locking system of claim 16 wherein the rotary members include a plurality of wheels that rotate about respective first and second axes that form an angle of between 70 and 110 degrees.

19. The bearing and turning system of claim 16 wherein the rotary members include a plurality of wheels that rotate about respective first and second axes that form an angle of about ninety (90° ) degrees.

20. The bearing, turning, and locking system of claim 1 wherein the motion controllers are cylinders that are at least partially filled with fluid.

21. The bearing, turning, and locking system of claim 20 wherein the cylinders are pneumatic.

* * * * *